US009248545B2

(12) United States Patent
Seki et al.

(10) Patent No.: US 9,248,545 B2
(45) Date of Patent: Feb. 2, 2016

(54) SUBSTRATE PROCESSING APPARATUS AND SUBSTRATE PROCESSING METHOD

(71) Applicant: EBARA CORPORATION, Tokyo (JP)

(72) Inventors: Masaya Seki, Tokyo (JP); Tetsuji Togawa, Tokyo (JP); Masayuki Nakanishi, Tokyo (JP); Kenya Ito, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 14/510,033

(22) Filed: Oct. 8, 2014

(65) Prior Publication Data

US 2015/0104999 A1 Apr. 16, 2015

(30) Foreign Application Priority Data

Oct. 11, 2013 (JP) ..... 2013-213489

(51) Int. Cl.

| | |
|---|---|
| ***B24B 37/30*** | (2012.01) |
| ***B24B 37/34*** | (2012.01) |
| ***B24B 37/005*** | (2012.01) |
| ***B24B 49/12*** | (2006.01) |
| ***B24B 37/10*** | (2012.01) |

(52) U.S. Cl.

CPC ..... *B24B 37/345* (2013.01); *B24B 37/005* (2013.01); *B24B 37/10* (2013.01); *B24B 37/30* (2013.01); *B24B 49/12* (2013.01)

(58) Field of Classification Search

CPC .... B24B 37/345; B24B 37/005; B24B 37/10; B24B 37/30; B24B 49/12

USPC ..... 451/28, 5

See application file for complete search history.

(56) References Cited

U.S. PATENT DOCUMENTS 7,682,225 B2 * 3/2010 Hongo ..... B24B 9/065 451/168
8,047,896 B2 * 11/2011 Takahashi ..... B24B 21/004 451/311
8,267,741 B2 * 9/2012 Kimura ..... B24B 37/005 451/268
2012/0252320 A1 * 10/2012 Seki ..... B24B 9/065 451/28

FOREIGN PATENT DOCUMENTS

| | | |
|---|---|---|
| CN | 101450457 A | 6/2009 |
| EP | 2067571 A2 | 6/2009 |
| JP | 2001-230303 | 8/2001 |
| JP | 2010-186863 | 8/2010 |

OTHER PUBLICATIONS

European Patent Application No. 14188160.7; Extended European Search Report; dated Feb. 19, 2015; 6 pages.

* cited by examiner

*Primary Examiner* — George Nguyen
(74) *Attorney, Agent, or Firm* — Baker & Hostetler LLP

(57) ABSTRACT

A substrate processing apparatus capable of accurately aligning a center of a substrate, such as a wafer, with an axis of a substrate stage and capable of processing the substrate without bending the substrate is disclosed. The substrate processing apparatus includes a first substrate stage having a first substrate-holding surface configured to hold a first region in a lower surface of the substrate, a second substrate stage having a second substrate-holding surface configured to hold a second region in the lower surface of the substrate, a stage elevator configured to move the first substrate-holding surface between an elevated position higher than the second substrate-holding surface and a lowered position lower than the second substrate-holding surface, and an aligner configured to measure an amount of eccentricity of a center of the substrate from the axis of the second substrate stage and align the center of the substrate with the axis of the second substrate stage.

13 Claims, 9 Drawing Sheets

SUBSTRATE PROCESSING APPARATUS AND SUBSTRATE PROCESSING METHOD

CROSS REFERENCE TO RELATED APPLICATION

This document claims priority to Japanese Application Number 2013-213489, filed Oct. 11, 2013, the entire contents of which are hereby incorporated by reference.

BACKGROUND

A polishing apparatus provided with a polishing tool, such as a polishing tape or a grinding stone, is used as an apparatus for polishing a peripheral portion of a substrate, such as a wafer. FIG. 14 is a schematic view showing this type of polishing apparatus, As shown in FIG. 14, the polishing apparatus includes a substrate stage 110 for holding a central portion of a wafer W by vacuum suction and rotating the wafer W, and a polishing head 105 for pressing a polishing tool 100 against a peripheral portion of the wafer W. The wafer W is rotated together with the substrate stage 110, and in this state the polishing head 105 presses the polishing tool 100 against the peripheral portion of the wafer W to thereby polish the peripheral portion of the wafer W. A polishing tape or a grinding stone may be used as the polishing tool 100.

As shown in FIG. 15, a width of a portion of the wafer W polished by the polishing tool 100 (which will be hereinafter referred to as a polishing width) is determined by a relative position of the polishing tool 100 with respect to the wafer W. Typically, the polishing width is several millimeters from an outermost peripheral edge of the wafer W, In order to polish the peripheral portion of the wafer W with a constant polishing width, it is necessary to align a center of the wafer W with an axis of the substrate stage 110. Therefore, before the wafer W is placed on the substrate stage 110, centering of the wafer W is performed by holding the wafer W with centering hands 115 as shown in FIG. 16. The centering hands 115 are configured to approach from both sides of the wafer W, which has been transported by a transfer robot (not shown), to contact an edge portion of the wafer W, thereby holding the wafer W. A relative position between the centering hands 115 and the substrate stage 110 is fixed, and the center of the wafer W held by the centering hands 115 is located on the axis of the substrate stage 110.

However, such a conventional centering mechanism has a limit to an accuracy of the wafer centering. As a result, the polishing width may be unstable. Moreover, the centering hands 115 may be worn out, resulting in a lowered accuracy of the wafer centering. Furthermore, when the polishing tool 100 is pressed against the peripheral portion of the wafer W, the wafer W in its entirety is bent, and as a result a defect may occur in the peripheral portion of the wafer W. In order to prevent the wafer W from being bent, a supporting stage (not shown) for supporting a circumferential portion of a lower surface of the wafer W may be provided separately from the substrate stage 110. However, if a substrate supporting surface of the substrate stage 110 is not flush with a substrate supporting surface of the supporting stage, the wafer W is bent.

SUMMARY OF THE INVENTION

According to embodiments, there are provided a substrate processing apparatus and a substrate processing method capable of accurately aligning a center of a substrate, such as a wafer, with an axis of a substrate stage and capable of performing substrate processing, such as polishing of a peripheral portion of the substrate, without bending the substrate.

Embodiments, which will be described below, relate to a. substrate processing apparatus and a substrate processing method that are applicable to a polishing apparatus and a polishing method for polishing a peripheral portion of a substrate (e.g., a wafer) and to other apparatus and method.

In an embodiment, there is provided a substrate processing apparatus for processing a substrate:, comprising: a first substrate stage having a first substrate-holding surface configured to hold a first region in a lower surface of the substrate; a second substrate stage having a second substrate-holding surface configured to hold a second region in the lower surface of the substrate; a second-stage rotating mechanism configured to rotate the second substrate stage about an axis of the second substrate stage; a stage elevator configured to move the first substrate-holding surface between an elevated position higher than the second substrate-holding surface and a lowered position lower than the second substrate-holding surface; and an aligner configured to measure an amount of eccentricity of a center of the substrate from the axis of the second substrate stage and align the center of the substrate with the axis of the second substrate stage.

In an embodiment, there is provided a substrate processing method for processing a substrate, comprising: holding a first region in a lower surface of the substrate by a first substrate-holding surface of a first substrate stage; measuring an amount of eccentricity of a center of the substrate from an axis of a second substrate stage; aligning the center of the substrate with the axis of the second substrate stage; lowering the first substrate stage until a second region in the lower surface of the substrate contacts a second substrate-holding surface of the second substrate stage; holding the second region by the second substrate-holding surface; farther lowering the first substrate stage to separate the first substrate-holding surface from the substrate; rotating the second substrate stage about the axis of the second substrate stage to thereby rotate the substrate; and processing the rotating substrate.

According to the above-described embodiments, the amount of eccentricity of the center of the substrate from the axis of the second substrate stage is measured, Therefore, the center of the substrate can be aligned with the axis of the second substrate stage so that the amount of eccentricity is zero. Further, after the second substrate stage holds the second region (in particular, an outer circumferential portion) of the lower surface of the substrate, the first substrate stage can be separated from the substrate. Therefore, the substrate can be processed without being bent, while only the second substrate stage is holding the second region of the lower surface of the substrate.

DESCRIPTION OF EMBODIMENTS

Embodiments will be described below with reference to drawings. The following embodiments of a substrate processing apparatus and a substrate processing method are directed to a polishing apparatus and a polishing method for polishing a peripheral portion of a substrate.

Figure 1:
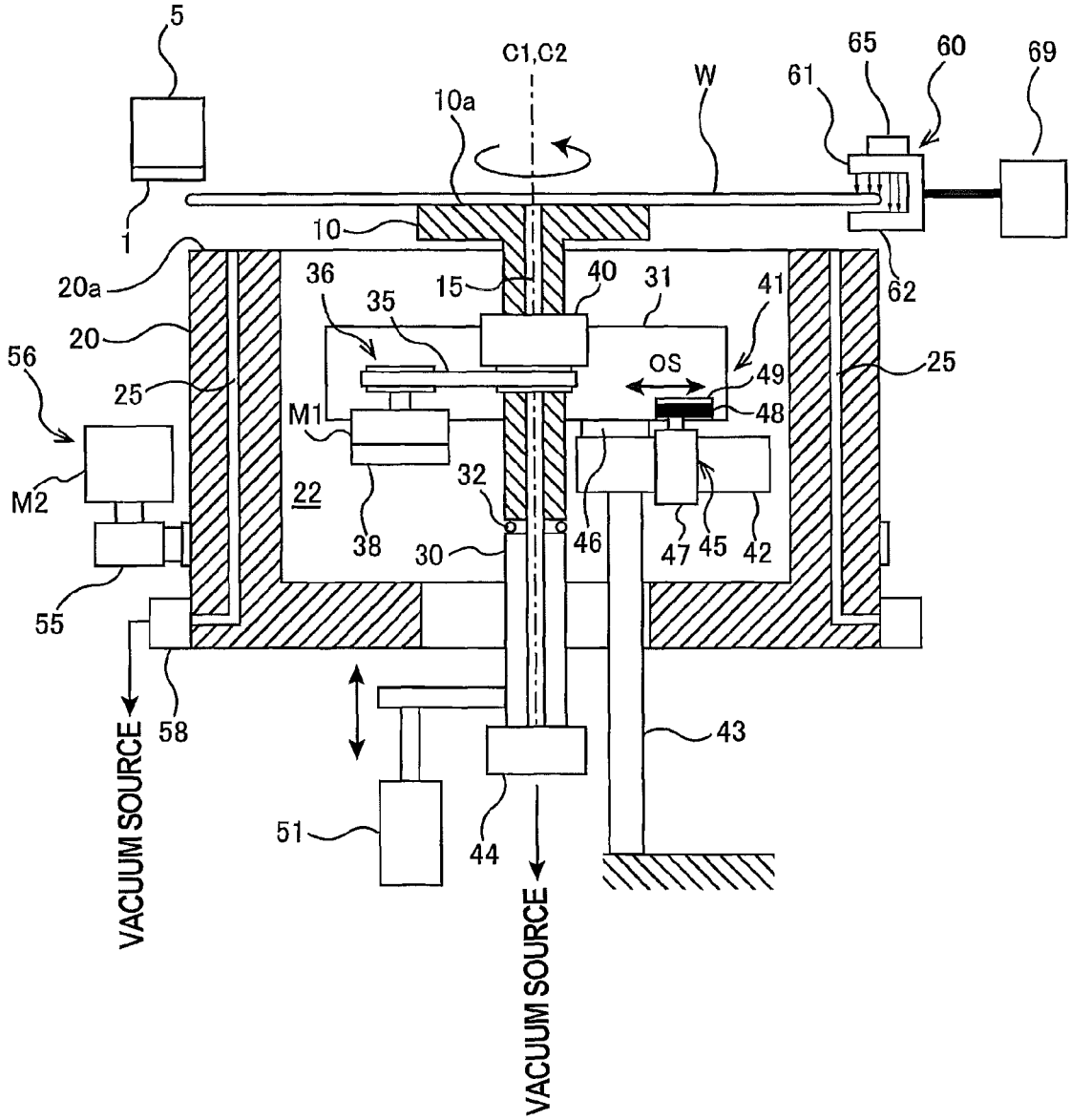
FIG. 1 is a schematic view showing a polishing apparatus.

FIG. 1 is a schematic view showing the polishing apparatus, As shown in FIG. 1, the polishing apparatus has a first substrate stage 10 and a second substrate stage 20 each for holding the wafer W which is an example of a substrate. The first substrate stage 10 is a centering stage for performing centering of the wafer W, and the second substrate stage 20 is a process stage for polishing the wafer W. During centering of the wafer W, the wafer W is held by only the first substrate stage 10, and during polishing of the wafer W, the wafer W is held by only the second substrate stage 20.

The second substrate stage 20 has a space 22 formed therein, and the first substrate stage 10 is housed in the space 22 of the second substrate stage 20. The first substrate stage 10 has a first substrate-holding surface 10*a* for holding a first region in a lower surface of the wafer W. The second substrate stage 20 has a second substrate-holding surface 20*a* for holding a second region in the lower surface of the wafer W. The first region and the second region are regions lying at different locations in the lower surface of the wafer W. In this embodiment, the first substrate-holding surface 10*a* has a circular shape and is configured to hold a center-side portion of the lower surface of the wafer W. The second substrate-holding surface 20*a* has an annular shape and is configured to hold an outer circumferential portion of the lower surface of the wafer W. The center-side portion is located inside the outer circumferential portion. The center-side portion in this embodiment is a circular portion including a central point of the wafer W. However, the center-side portion may be an annular portion not including the central point of the wafer W, so long as the center-side portion is located inside the outer circumferential portion. The second substrate-holding surface 20*a* is located so as to surround the first substrate-holding surface 10*a*. The second substrate-holding surface 20*a* in an annular shape may have a width in a range of 5 mm to 50 mm.

The first substrate stage 10 is coupled to a support shaft 30 through a bearing 32. The support shaft 30 is located below the first substrate stage 10. The bearing 32 is fixed to an upper end of the support shaft 30, and rotatably supports the first substrate stage 10. The first substrate stage 10 is coupled to a motor M1 through a torque transmission mechanism 35 constituted by pulleys, a belt, and other components, so that the first substrate stage 10 is rotated about its axis. The motor M1 is secured to a connection block 31. The motor M1 and the torque transmission mechanism 35 constitute a first rotating mechanism (or a first-stage rotating mechanism) 36 that rotates the first substrate stage 10 about its axis C1. A rotary encoder 38 is coupled to the motor M1 so that a rotation angle of the first substrate stage 10 is measured by the rotary encoder 38.

A first vacuum line 15, extending in an axial direction of the first substrate stage 10 and the support shaft 30, is disposed in the first substrate stage 10 and the support shaft 30. This first vacuum line 15 is coupled to a vacuum source (not shown) through a rotary joint 44 which is fixed to a lower end of the support shaft 30. A top-end opening of the first vacuum line 15 lies in the first substrate-holding surface 10*a*. Therefore, when a vacuum is produced in the first vacuum line 15, the center-side portion of the wafer W is held on the first. substrate-holding surface 10*a* by a vacuum suction.

The first substrate stage 10 is coupled to a stage elevator 51 through the support shaft 30. The stage elevator 51 is located below the second substrate stage 20, and is coupled to the support shaft 30. The stage elevator 51 is configured to be able to elevate and tower the support shaft 30 and the first substrate stage 10 together.

The first substrate stage 10 is coupled to a horizontally-moving mechanism 41 which is configured to move the first substrate stage 10 along a predetermined offset axis OS extending horizontally. The first substrate stage 10 is rotatably supported by a linear motion bearing 40, which is fixed to the connection block 31. The linear motion bearing 40 is configured to rotatably support the first substrate stage 10 while permitting a vertical movement of the first substrate stage 10. A ball spline bearing may be used as the linear motion bearing 40.

The horizontally-moving mechanism 41 includes the above-described connection block 31, an actuator 45 for moving the first substrate stage 10 in the horizontal direction, and a linear motion guide 46 that restricts the horizontal movement of the first substrate stage 10 to the horizontal movement along the offset axis OS. This offset axis OS is an imaginative movement axis extending in a longitudinal direction of the linear motion guide 46. The offset axis OS is indicated by arrow in FIG. 1.

The linear motion guide 46 is fixed to a base 42, This base 42 is fixed to a support arm 43 which is connected to a stationary member, such as a frame, of the polishing apparatus. The connection block 31 is supported by the linear motion guide 46 that allows the connection block 31 to move in the horizontal direction. The actuator 45 includes an offset motor 47 fixed to the base 42, an eccentric cam 48 secured to a drive shaft of the offset motor 47, and a recessed portion 49 formed in the connection block 31. The eccentric cam 48 is housed in the recessed portion 49. When the offset motor 47 rotates the eccentric cam 48, the eccentric cam 48, while contacting the recessed portion 49, moves the connection block 31 horizontally along the offset axis OS.

When the actuator 45 is set in motion, the first substrate stage 10 is moved horizontally along the offset axis OS with its movement direction guided by the linear motion guide 46. A position of the second substrate stage 20 is fixed. Therefore, the horizontally-moving mechanism 41 moves the first substrate stage 10 horizontally relative to the second substrate stage 20, and the stage elevator 51 moves the first substrate stage 10 vertically relative to the second substrate stage 20.

The first substrate stage 10, the first rotating mechanism 36, and the horizontally-moving mechanism 41 are housed in the space 22 of the second substrate stage 20. Therefore, a substrate holder, which is constructed by the first substrate stage 10, the second substrate stage 20, and other elements, can be made compact. Further, the second substrate stage 20 can protect the first substrate stage 10 from a polishing liquid (e.g., pure water or a chemical liquid) supplied to a surface of the wafer W during polishing of the wafer W.

The second substrate stage 20 is rotatably supported by a bearing which is not shown in the drawings. The second substrate stage 20 is coupled to the motor M2 through a torque transmission mechanism 55 that is constituted by pulleys, a belt, and other components. The second substrate stage 20 is configured to be rotated about its axis C2. The motor M2 and the torque transmission mechanism 55 constitute a second rotating mechanism (or a second-stage rotating mechanism) 56 that rotates the second substrate stage 20 about its axis C2.

An upper surface of the second substrate stage 20 constitutes the annular second substrate-holding surface 20*a*. A plurality of second vacuum lines 25 are disposed in the second substrate stage 20. These second vacuum lines 25 are coupled to a vacuum source (not shown) through a rotary joint 58. Top-end openings of the second vacuum lines 25 lie in the second substrate-holding surface 20*a*. Therefore, when a vacuum is produced in the second vacuum lines 25, the outer circumferential portion of the lower surface of the wafer W is held on the second substrate-holding surface 20*a* by the vacuum suction. The second substrate-holding surface 20*a* has an outer diameter that is equal to or smaller than a diameter of the wafer W.

A polishing head 5 for pressing a polishing tool 1 against a peripheral portion of the wafer W is disposed above the second substrate-holding surface 20*a* of the second substrate stage 20. The polishing head 5 is configured to be movable in the vertical direction and in the radial direction of the wafer W. The polishing head 5 polishes the peripheral portion of the wafer W by pressing the polishing tool 1 downwardly against the peripheral portion of the rotating wafer W. A polishing tape or a grinding stone may be used as the polishing tool 1.

An eccentricity detector 60 for measuring an amount of eccentricity of the center of the wafer W, held by the first substrate stage 10, from the axis C2 of the second substrate stage 20 is disposed above the second substrate stage 20. This eccentricity detector 60 is an optical eccentricity sensor, which includes a light-emitting device 61 for emitting light, a light-receiving device 62 for receiving tight, and a processor 65 for determining the amount of eccentricity of the wafer W from a quantity of light that is measured by the light-receiving device 62. The eccentricity detector 60 is coupled to a laterally-moving mechanism 69, so that the eccentricity detector 60 can move in directions closer to and away from the peripheral portion of the wafer W.

The amount of eccentricity of the wafer W is measured when the axis C1 of the first substrate stage 10 coincides with the axis C2 of the second substrate stage 20, Specifically, the amount of eccentricity of the wafer W is measured as follows. The eccentricity detector 60 is moved toward the peripheral portion of the wafer W until the peripheral portion of the wafer W is located between the light-emitting device 61 and the light-receiving device 62. In this state, the light-emitting device 61 emits the light toward the light-receiving device 62, while the wafer W is rotated about the axis C1 of the first substrate stage 10 (and the axis C2 of the second substrate stage 20). A part of the light is interrupted by the wafer W, while other part of the light reaches the light-receiving device 62.

Figure 2:
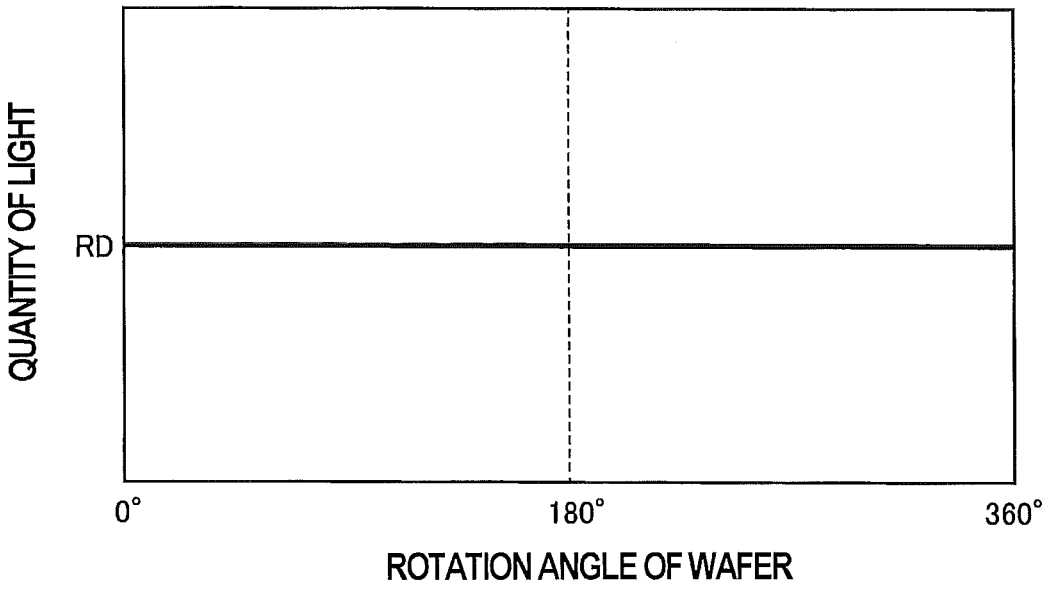
FIG. 2 is a graph showing a quantity of light obtained while a wafer is making one revolution.
Figure 3:
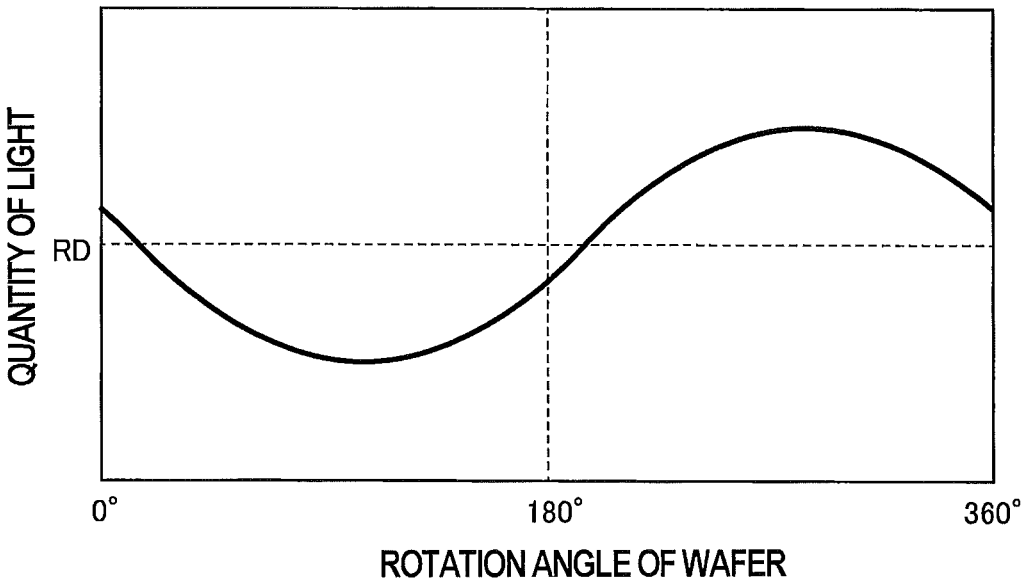
FIG. 3 is a graph showing a quantity of light obtained while a wafer is making one revolution.

The quantity of light measured by the light-receiving device 62 varies depending on a relative position of the wafer W and the first substrate stage 10. In the case where the center of the wafer W is on the axis C1 of the first substrate stage 10, the quantity of light obtained while the wafer W is making one revolution is maintained at a predetermined reference quantity of light RD, as shown in FIG. 2. On the contrary, in the case where the center of the wafer W deviates from the center of the axis C1 of the substrate stage 10, the quantity of light obtained while the wafer W is making one revolution varies in accordance with the rotation angle of the wafer W, as shown in FIG. 3.

The amount of eccentricity of the wafer W is inversely proportional to the quantity of light measured by the light-receiving device 62. in other words, an angle of the wafer W at which the quantity of light is minimized is an angle at which the amount of eccentricity of the wafer W is maximized. The above-described reference quantity of light RD is a quantity of light that has been measured in a state such that a center of a reference wafer (or a reference substrate), having a reference diameter (e.g., 300.00 nm in diameter), is on the axis C1 of the first substrate stage 10. This reference quantity of light RD is stored in advance in the processor 65. Further, data (e.g., a table, or a relational expression) representing a relationship between the quantity of light and the amount of eccentricity of the wafer W from the axis C1 of the first substrate stage 10 is stored in advance in the processor 65. The amount of eccentricity corresponding to the reference quantity of light RD is zero. The processor 65 determines the amount of eccentricity of the wafer W from a measured value of the quantity of light based on the data.

The processor 65 of the eccentricity detector 60 is coupled to the rotary encoder 38, and a signal indicating the rotation angle of the first substrate stage 10 (i.e., the rotation angle of the wafer is sent from the rotary encoder 38 to the processor 65. The processor 65 determines a maximum eccentric angle that is an angle of the wafer W at which the quantity of light is minimized. A maximum eccentric, point on the wafer W, which is farthest from the axis C1 of the first substrate stage 10, is identified by the maximum eccentric angle. The amount of eccentricity of the wafer W is measured with the axis C1 of the first substrate stage 10 coinciding with the axis C2 of the second substrate stage 20. Therefore, the processor 65 can determine a maximum eccentric point on the wafer W which is farthest from the axis C2 of the second substrate stage 20. Further, the processor 65 can determine the amount of eccentricity of the wafer W from the axis C2 of the second substrate stage 20 from the quantity of light.

Figure 4:
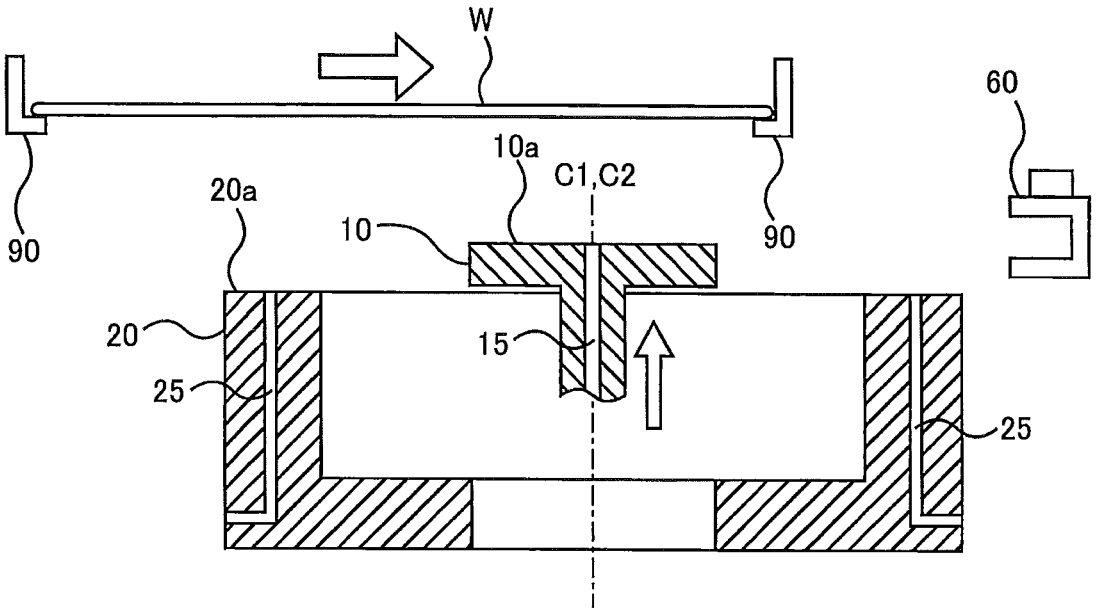
FIG. 4 is a schematic view illustrating an operation sequence of the polishing apparatus.

Next, an operation sequence of the polishing apparatus for polishing the wafer W will be described with reference to FIGS. 4 through 12. In FIGS. 4 through 12, components other than the first substrate stage 10, the second substrate stage 20, and the eccentricity detector 60 are omitted. First, the first substrate stage 10 is moved horizontally by the horizontally-moving mechanism 41 (see FIG. 1) until the axis C1 of the first substrate stage 10 is aligned with the axis C2 of the second substrate stage 20. Further, as shown in FIG. 4, the first substrate stage 10 is elevated to an elevated position by the stage elevator 51. In this elevated position, the first substrate-holding surface 10*a* of the first substrate stage 10 is located higher than the second substrate-holding surface 20*a* of the second substrate stage 20.

Figure 5:
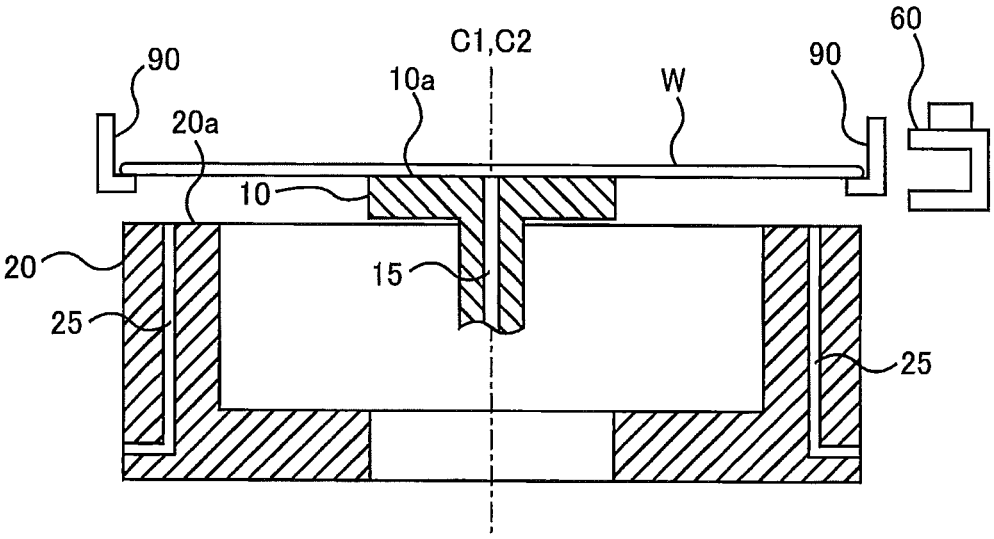
FIG. 5 is a schematic view illustrating the operation sequence of the polishing apparatus.
Figure 6:
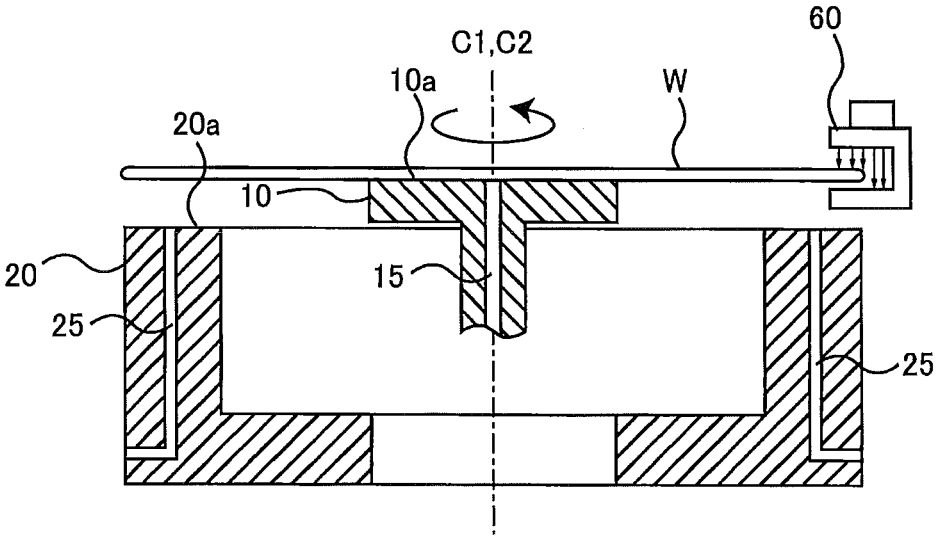
FIG. 6 is a schematic view illustrating the operation sequence of the polishing apparatus.

In this state, the wafer W is transported by hands 90 of a transporting mechanism. As shown in FIG. 5, the wafer W is placed onto the circular first substrate-holding surface 10*a* of the first substrate stage 10. The vacuum is produced in the first vacuum line 15, so that the center-side portion of the lower surface of the wafer W is held on the first substrate-holding surface 10*a* by the vacuum suction. Thereafter, as shown in FIG. 6, the hands 90 of the transporting mechanism move away from the polishing apparatus, and the first substrate stage 10 is rotated about its axis C1. The eccentricity detector 60 approaches the wafer W and measures the amount of eccentricity of the wafer W as described above. Further, the eccentricity detector 60 determines the maximum eccentric point on the wafer W that is farthest from the axis C1 of the first substrate stage 10.

Figure 7:
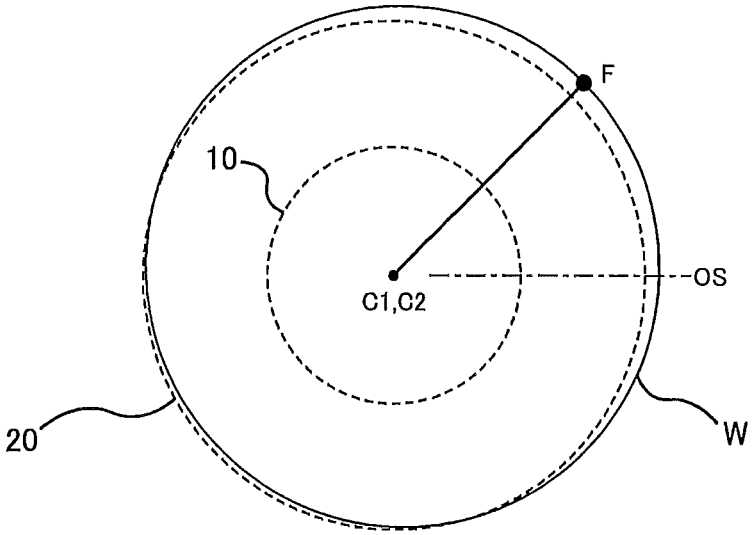
FIG. 7 is a plan view illustrating a step for correcting an eccentricity of the wafer.
Figure 8:
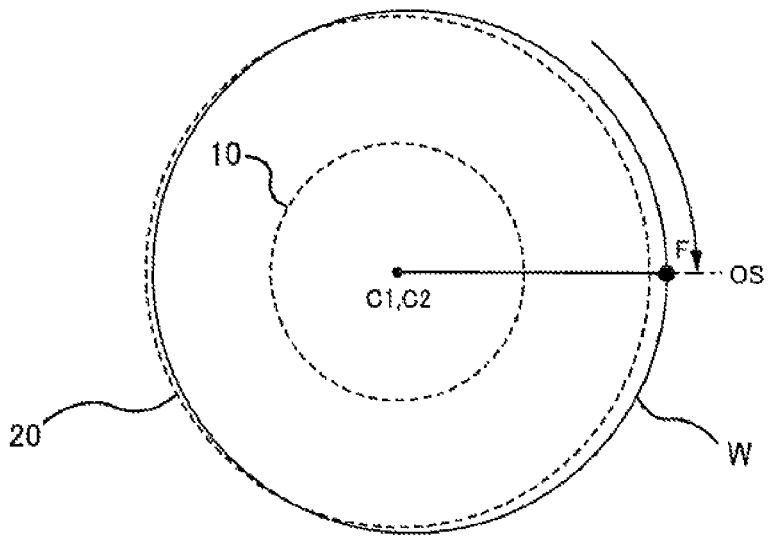
FIG. 8 is a plan view illustrating a step for correcting the eccentricity of the wafer.
Figure 9:
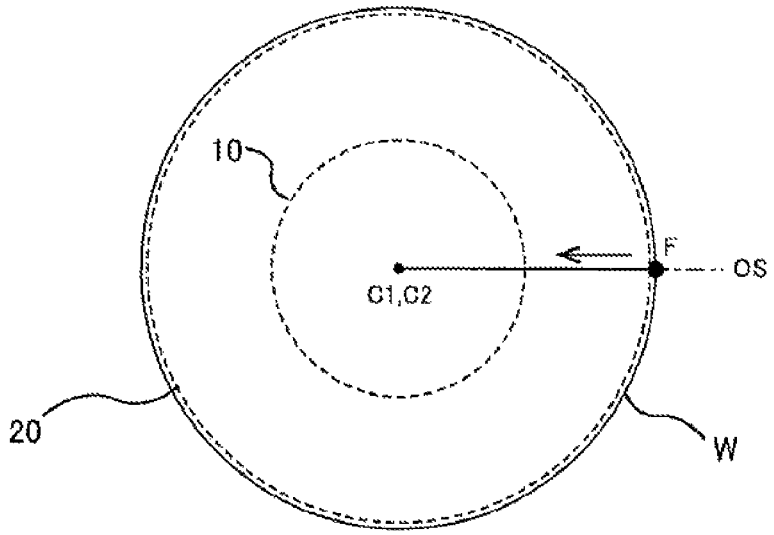
FIG. 9 is a plan view illustrating a step for correcting the eccentricity of the wafer.

FIGS. 7 through 9 are plan views of the wafer W on the first substrate stage 10. In the example shown in FIG. 7, the center of the wafer W, placed on the first substrate stage 10, is out of alignment with the axes C1 and C2 of the substrate stages 10 and 20. A maximum eccentric point (imagination point) F on the wafer W that is farthest from the axes C1 and C2 of the substrate stages 10 and 20 is not on the offset axis (imagination axis) OS of the horizontally-moving mechanism 41 as viewed from above the wafer W. Thus, as shown in FIG. 8, the first substrate stage 10 is rotated until the maximum eccentric point F is located on the offset axis OS as viewed from above the wafer W. Specifically, the first substrate stage 10 is rotated until a line (imagination line) interconnecting the maximum eccentric point F and the axis C1 of the first substrate stage 10 becomes parallel to the offset axis OS. The rotation angle of the first substrate stage 10 at this time corresponds to a difference between an angle that identifies the position of the maximum eccentric point F and an angle that identifies the position of the offset axis OS.

Further, as shown in FIG. 9, while the maximum eccentric point F is on the offset axis OS, the first substrate stage 10 is moved by the horizontally-moving mechanism 41 (see FIG. 1) along the offset axis OS until the center of the wafer W held on the first substrate stage 10 is located on the axis C2 of the second substrate stage 20. A movement distance of the first substrate stage 10 at this time corresponds to the amount of eccentricity of the wafer W. In this manner, the center of the wafer W is aligned with the axis of the second substrate stage 20. In this embodiment, an aligner for aligning the center of the wafer W with the axis of the second substrate stage 20 is constructed by the eccentricity detector 60, the first rotating mechanism 36, and the horizontally-moving mechanism 41.

Figure 10:
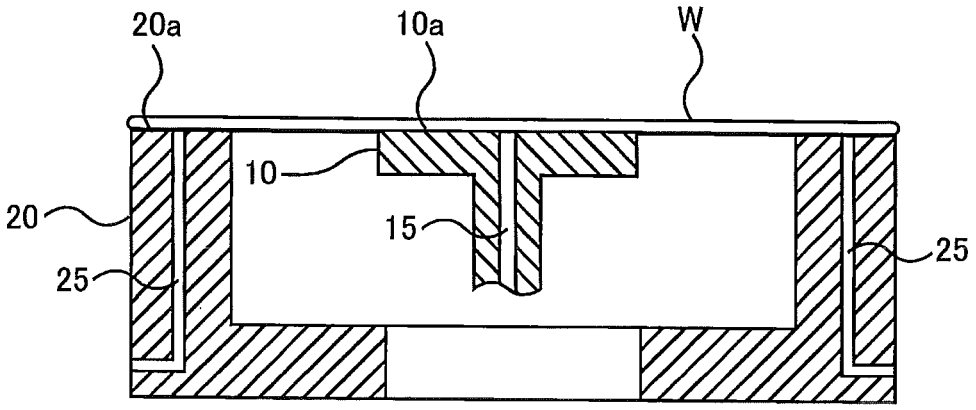
FIG. 10 is a schematic view illustrating the operation sequence of the polishing apparatus.
Figure 11:
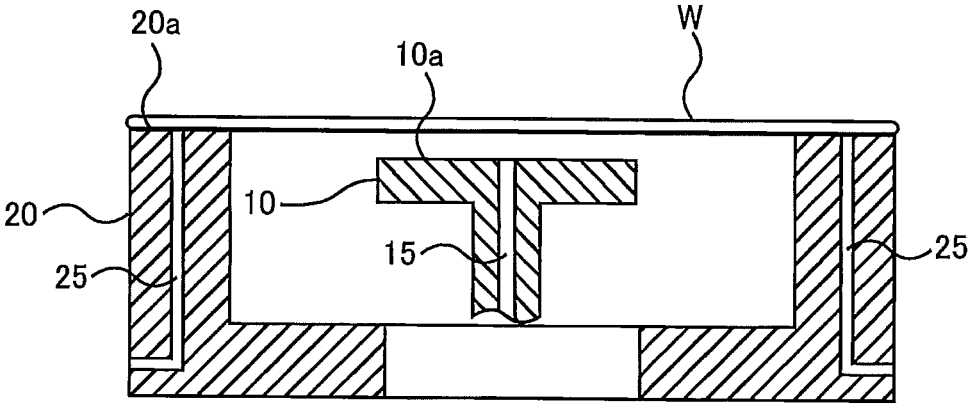
FIG. 11 is a schematic view illustrating the operation sequence of the polishing apparatus.

Next, as shown in FIG. 10, the first substrate stage 10 is lowered until the outer circumferential portion of the lower surface of the wafer W contacts the second substrate-holding surface 20*a* of the second substrate stage 20. In this state, the vacuum is produced in the second vacuum lines 25, so that the outer circumferential portion of the lower surface of the wafer W is held on the second substrate stage 20 by the vacuum suction. Thereafter, the first vacuum line 15 is vented to the atmosphere. As shown in FIG. 11, the first substrate stage 10 is further lowered to a predetermined lowered position at which the first substrate-holding surface 10*a* of the first substrate stage 10 is separated from the wafer W. As a result, the wafer W is held only by the second substrate stage 20.

The first substrate stage 10 holds only the center-side portion of the lower surface of the wafer W, and the second substrate stage 20 holds only the outer circumferential portion of the lower surface of the wafer W. When the wafer W is held by both the first substrate stage 10 and the second substrate stage 20 simultaneously, the wafer W may be bent. This is because it is very difficult from a viewpoint of a mechanical positioning precision to locate the first substrate-holding surface 10*a* of the first substrate stage 10 and the second substrate-holding surface 20*a* of the second substrate stage 20 in the same horizontal plane. According to the present embodiment, during polishing of the wafer W, only the outer circumferential portion of the lower surface of the wafer W is held by the second substrate stage 20, and the first substrate stage 10 is kept away from the wafer W. Therefore, bending of the wafer W can be prevented.

Figure 12:
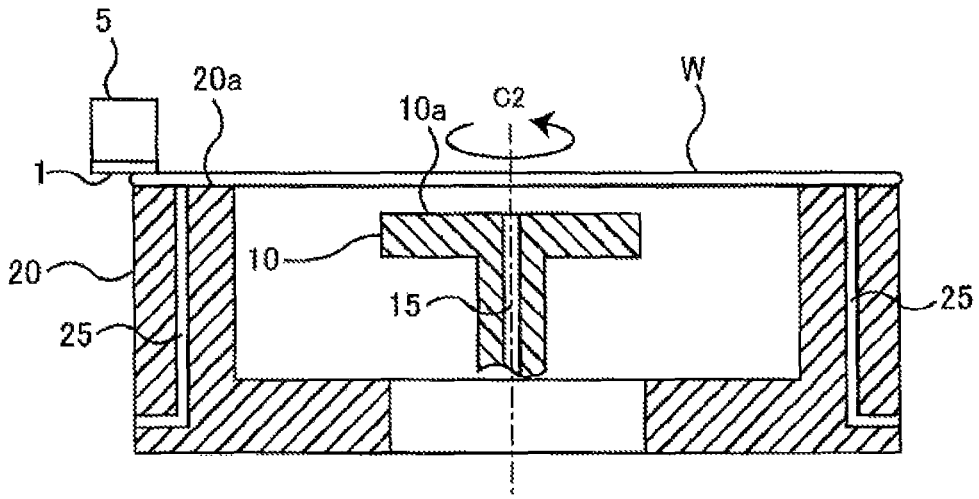
FIG. 12 is a schematic view illustrating the operation sequence of the polishing apparatus.

As shown in FIG. 12, the second substrate stage 20 is rotated about its axis (22. Since the center of the wafer W is on the axis C2 of the second substrate stage 20, the wafer W is rotated about the center thereof. In this state, the polishing head 5 presses the polishing tool 1 against the peripheral portion of the rotating wafer W, while the polishing liquid (e.g., pure water or slurry) is being supplied from a polishing liquid supply nozzle (not shown) onto the wafer W, thereby polishing the peripheral portion. Since the outer circumferential portion of the lower surface of the wafer W is held by the second substrate stage 20 during polishing of the wafer W, a load of the polishing tool 1 can be received from below the polishing tool 1. Therefore, bending of the wafer W can be prevented during polishing.

The polished wafer W is removed from the polishing apparatus in accordance with a reverse operating sequence. The annular second substrate-holding surface 20*a* further has an advantage that the wafer W is not likely to be broken when the polished wafer W is separated from the second substrate-holding surface 20*a*, compared with a substrate stage that attracts the lower surface of the wafer in its entirety.

A width of a portion of the wafer W polished by the polishing tool 1 (which will be hereinafter referred to as a polishing width) is determined by a relative position of the polishing tool 1 with respect to the wafer W. Some wafers may have diameters slightly larger than a predetermined reference diameter (e.g., 300.00 mm) or smaller than. the predetermined reference diameter. If the diameter varies from wafer to wafer, the relative position of the polishing tool 1 with respect to the wafer varies from wafer to wafer. As a result, the polishing width also varies from wafer to wafer. In order to prevent such a variation in the polishing width, it is desirable to measure the diameter of a wafer prior to polishing of the wafer.

Figure 13:
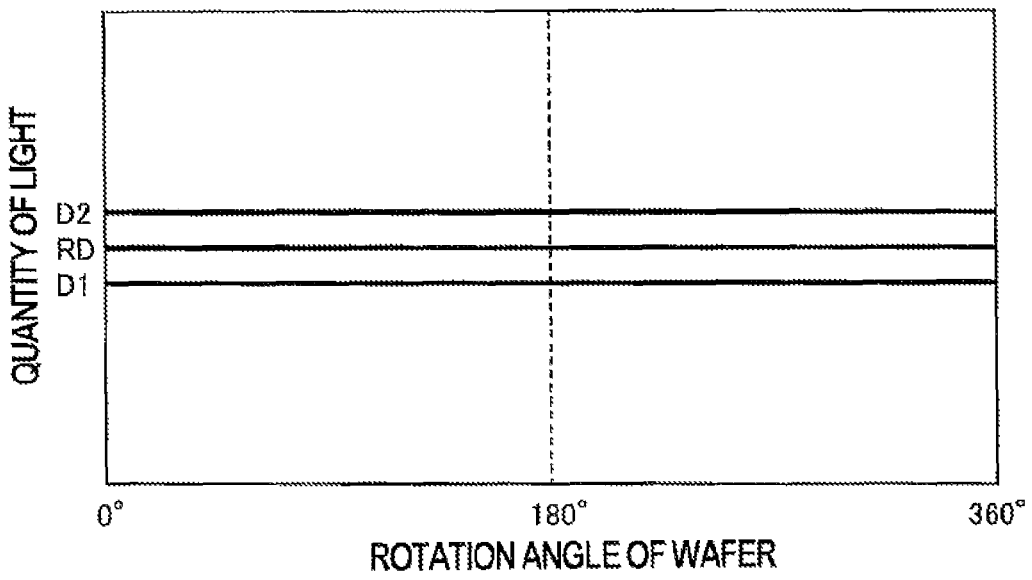
FIG. 13 is a graph showing a quantity of light obtained while a wafer is making one revolution.
Figure 14:
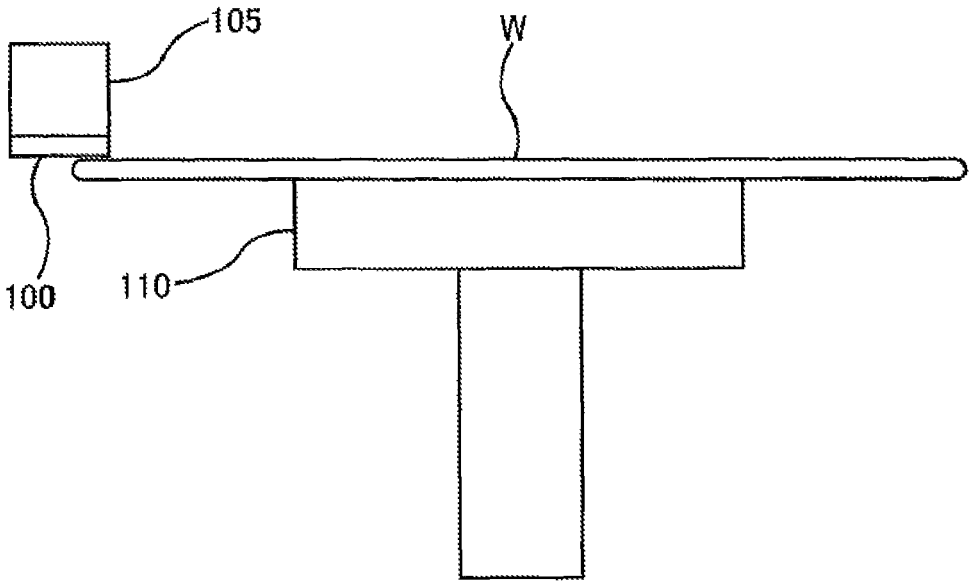
FIG. 14 is a schematic view showing a conventional polishing apparatus.
Figure 15:
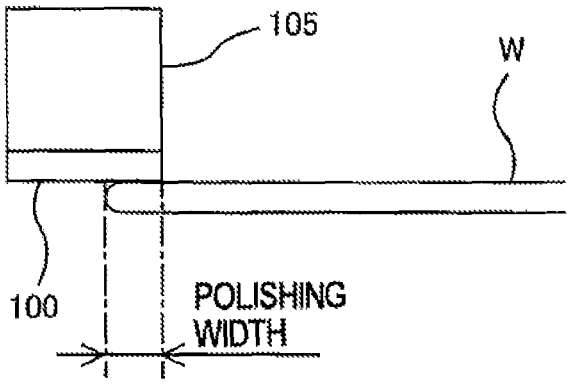
FIG. 15 is a view illustrating a polishing width of a wafer.
Figure 16:
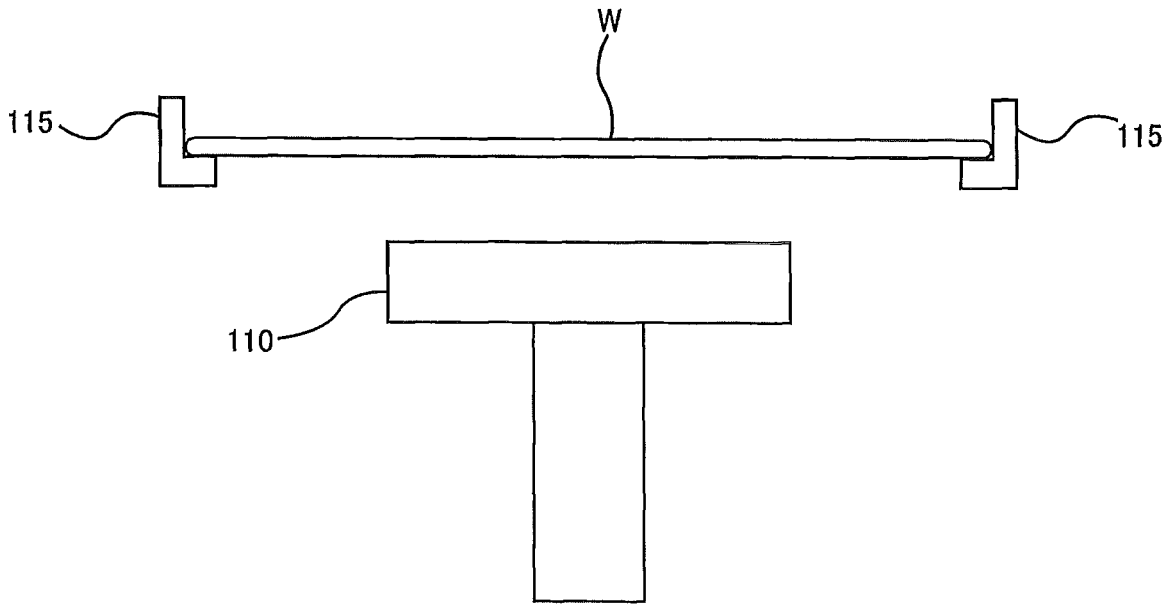
FIG. 16 is a schematic view showing the conventional polishing apparatus including centering hands.

The eccentricity detector 60 shown in FIG. 1 is configured to be able to measure a diameter of a wafer. As shown in FIG. 13, an average D1 of the quantity of light obtained during one revolution of a wafer having a diameter (e.g., 300.10 mm), which is slightly larger than the predetermined reference diameter (e.g., 300.00 mm), is smaller than the reference quantity of light RD, because the quantity of light as a whole slightly decreases. An average D2 of the quantity of light obtained during one revolution of a wafer having a diameter (e.g., 299.90 mm), which is slightly smaller than the predetermined reference diameter, is larger than the reference quantity of light RD, because the quantity of light as a whole slightly increases.

A difference between the reference quantity of light RD and the average of the measured quantity of light corresponds to a difference between the reference diameter and an actual diameter of the wafer W on the first substrate stage 10. Therefore, the processor 65 can determine the actual diameter of the wafer W on the first substrate stage 10 based on the difference between the reference quantity of light RD and the average of the measured quantity of light.

As described above, since the eccentricity detector 60 can measure the diameter of the wafer W, the polishing width can be accurately adjusted based on the measured value of the diameter. In other words, since a position of an outermost edge of the wafer W can be accurately obtained, the relative position of the polishing tool 1 with respect to the wafer W can be adjusted based on the position of the outermost edge of the wafer W. As a result, the polishing tool 1 can polish the peripheral portion of the wafer W with a desired polishing width.

The above-described polishing apparatus is an embodiment of the substrate processing apparatus of the present invention. However, the substrate processing apparatus and the substrate processing method of the present invention can be applied to other apparatus and method for processing a substrate while holding the substrate, such as an apparatus and a method for CVD, and an apparatus and a method for sputtering.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A substrate processing apparatus for processing a substrate, comprising:

a first substrate stage having a first substrate-holding surface configured to hold a first region in a lower surface of the substrate;

a second substrate stage having a second substrate-holding surface configured to hold a second region in the lower surface of the substrate;

a second-stage rotating mechanism configured to rotate the second substrate stage about an axis of the second substrate stage;

a stage elevator configured to move the first substrate-holding surface between an elevated position higher than the second substrate-holding surface and a lowered position lower than the second substrate-holding surface; and an aligner configured to measure an amount of eccentricity of a center of the substrate from the axis of the second substrate stage and align the center of the substrate with the axis of the second substrate stage.

2. The substrate processing apparatus according to claim 1, wherein:

the second region is an outer circumferential portion of the lower surface of the substrate; and the first region is a center-side portion of the lower surface of the substrate located inside the outer circumferential portion.

3. The substrate processing apparatus according to claim 1, wherein the second substrate-holding surface is configured to hold the second region by vacuum suction.

4. The substrate processing apparatus according to claim 1, wherein the aligner comprises:

an eccentricity detector configured to measure the amount of eccentricity and determine a maximum eccentric point on the substrate that is farthest from an axis of the first substrate stage;

a first-stage rotating mechanism configured to rotate the first substrate stage until a line interconnecting the maximum eccentric point and the axis of the first substrate stage becomes parallel to a predetermined offset axis extending horizontally; and a horizontally-moving mechanism configured to move the first substrate stage along the offset axis until the center of the substrate held by the first substrate stage is located on the axis of the second substrate stage.

5. The substrate processing apparatus according to claim 4, wherein the first substrate stage, the first-stage rotating mechanism, and the horizontally-moving mechanism are housed in the second substrate stage.

6. The substrate processing apparatus according to claim 4, wherein the eccentricity detector is configured to measure a diameter of the substrate held on the first substrate stage.

7. The substrate processing apparatus according to claim 1, further comprising:

a polishing head configured to press a polishing tool against a peripheral portion of the substrate held by the second substrate stage to polish the peripheral portion.

8. A substrate processing method for processing a substrate, comprising:

holding a first region in a lower surface of the substrate by a first substrate-holding surface of a first substrate stage;

measuring an amount of eccentricity of a center of the substrate from an axis of a second substrate stage;

aligning the center of the substrate with the axis of the second substrate stage;

lowering the first substrate stage until a second region in the lower surface of the substrate contacts a second substrate-holding surface of the second substrate stage;

holding the second region by the second substrate-holding surface;

further lowering the first substrate stage to separate the first substrate-holding surface from the substrate;

rotating the second substrate stage about the axis of the second substrate stage to thereby rotate the substrate; and processing the rotating substrate.

9. The substrate processing method according to claim 8, wherein:

the second region is an outer circumferential portion of the lower surface of the substrate; and the first region is a center-side portion of the lower surface of the substrate located inside the outer circumferential portion.

10. The substrate processing method according to claim 8, wherein the second substrate-holding surface holds the second region by vacuum suction.

11. The substrate processing method according to claim 8, wherein aligning the e center of the substrate with the axis of the second substrate stage comprises:

determining a maximum eccentric point on the substrate that is farthest from an axis of the first substrate stage;

rotating the first substrate stage until a line interconnecting the maximum eccentric point and the axis of the first substrate stage becomes parallel to a predetermined offset axis extending horizontally; and moving the first substrate stage along the offset axis until the center of the substrate held by the first substrate stage is located on the axis of the second substrate stage.

12. The substrate processing method according to claim 8, further comprising:

measuring a diameter of the substrate held on the first substrate stage.

13. The substrate processing method according to claim 8, wherein processing the rotating substrate comprises pressing a polishing tool against a peripheral portion of the rotating substrate to polish the peripheral portion.

* * * * *